US005181546A

United States Patent [19]

Synek

[11] Patent Number: 5,181,546

[45] Date of Patent: Jan. 26, 1993

[54] BANDING APPARATUS

[75] Inventor: Wenzel Synek, Rudolfstetten, Switzerland

[73] Assignee: Fromm Holding AG, Cham, Switzerland

[21] Appl. No.: 749,566

[22] Filed: Aug. 26, 1991

[30] Foreign Application Priority Data

Jun. 7, 1991 [CH] Switzerland ..... 1714/91

[51] Int. Cl.[5] ..... B21F 9/02

[52] U.S. Cl. ..... 140/93.4; 140/152

[58] Field of Search ..... 140/93.2, 93.4, 150, 140/151, 153, 154; 72/19, 31, 35

[56] References Cited

U.S. PATENT DOCUMENTS 2,622,440 12/1952 Friedman ..... 72/32
3,241,579 3/1966 Partridge ..... 140/93.2
4,056,128 11/1977 Konrad .
4,192,043 3/1980 Konrad .
4,398,572 8/1983 Fromm .

*Primary Examiner*—Lowell A. Larson
*Attorney, Agent, or Firm*—George Pappas

[57] ABSTRACT

A banding apparatus including a housing and a base plate which are conected with each other through expansion screws. A receiving slot for receiving overlapping band sections is provided between the base plate and the housing. A band tightening device serves to tighten the overlapping band sections. A tool serves to connect the overlapping band sections. In the process, a drive device moves an upper tool part against a lower tool part on the base plate. The introduction of an excessive drive force in the tool and then the band sections to be connected is prevented by means of the expansion screws and/or is displayed, thereby preventing damage to the banding apparatus and the band sections to be sealed.

8 Claims, 2 Drawing Sheets

BANDING APPARATUS

FIELD OF THE INVENTION

The invention concerns a banding apparatus for connecting two overlapping band sections of steel or plastic.

DESCRIPTION OF THE RELATED ART

Banding apparatuses of the initially mentioned type are known severalfold, for instance, from the Swiss patent document 583,089 (corresponding to U.S. Pat. No. 4,056,128 or 4,192,043). The purpose of such an apparatus, e.g., is to provide two overlapping band sections of steel or plastic with a closure seal and hold them together. Another banding apparatus of the initially mentioned type is known from the Swiss patent document 646,388 (corresponding to U.S. Pat. No. 3,398,572), which serves to connect two overlapping band sections of steel with each other by punching and embossing. Banding apparatuses of that type feature a manual drive for the tools, where a pivoting lever interacts through an eccentric with an upper tool forcing and pressing it against the lower tool. The band section located between the upper and lower tools and, as the case may be, a closure seal are then connected with each other by the tools. Disadvantageous is that the force acting on the tool components cannot be exactly dosed or provided by means of the drive device and monitored. Tolerances of the components, closure seals and, as the case may be, contaminations change the travel of the manual lever for application of the sealing force, so that at equal lever travel different forces may be effective on the tool components and the band sections. This, in turn, may lead to a defective closure of the band sections and/or to damage on the banding apparatus.

The problem underlying the invention is to provide a banding apparatus of the initially mentioned type which does not display the cited disadvantages.

This problem is solved by the characterizing features of the present banding apparatus.

SUMMARY OF THE INVENTION

Since the base is connected with the housing by way of expansion screws, an exact coordination of the force is obtained at which the base plate is held on the housing. If this force is surmounted, for instance in sealing, the base plate will lift off the housing. For one, this results in preventing an excessive force effect on the banding apparatus and/or in the connecting band sections and, for another, the lift-off of the base from the housing is readily recognizable by the operator, enabling him to ascertain that the force exerted by the drive device has already reached the optimum limit.

Since the pre-stress of the expansion screws equal at least the closure force in sealing the band sections, the expansion of the expansion screws at a higher force automatically indicates that the sealing force for the band sections has been reached.

Basically it is possible to arrange several expansion screws in disturbed fashion. Particularly suitable is the arrangement of at least two expansion screws, since the expansion screws will then be situated relatively near the receiving slot and be able to bear on the base plate on the rear part of the housing. Given are thus optimum force conditions for the expansion screws and the observation of an excessive introduction of force.

An excessive introduction of force can be ascertained on the apparatus already by observation of the gap of the receiving slot in sealing, for an excessive force introduction presupposes a changes of the slot width of the receiving slot, which is readily evident. Favorable is a design, through the arrangement of an additional indicator device for the expansion of the expansion screws. Serving that purposes, e.g., may be a design, where the resistance change of the strain gauge band can be displayed on an appropriate display device. Also possible is a design incorporating a signal strip. Conceivable, lastly, would also be the arrangement of a micrometer on the housing, the probe of which acts upon a suitable point of the base plate.

Embodiments of the inventional banding apparatus will be more fully described hereinafter with the aid of the drawings.

DESCRIPTION OF THE PREFERRED EMBODIMENTS

Figure 1:
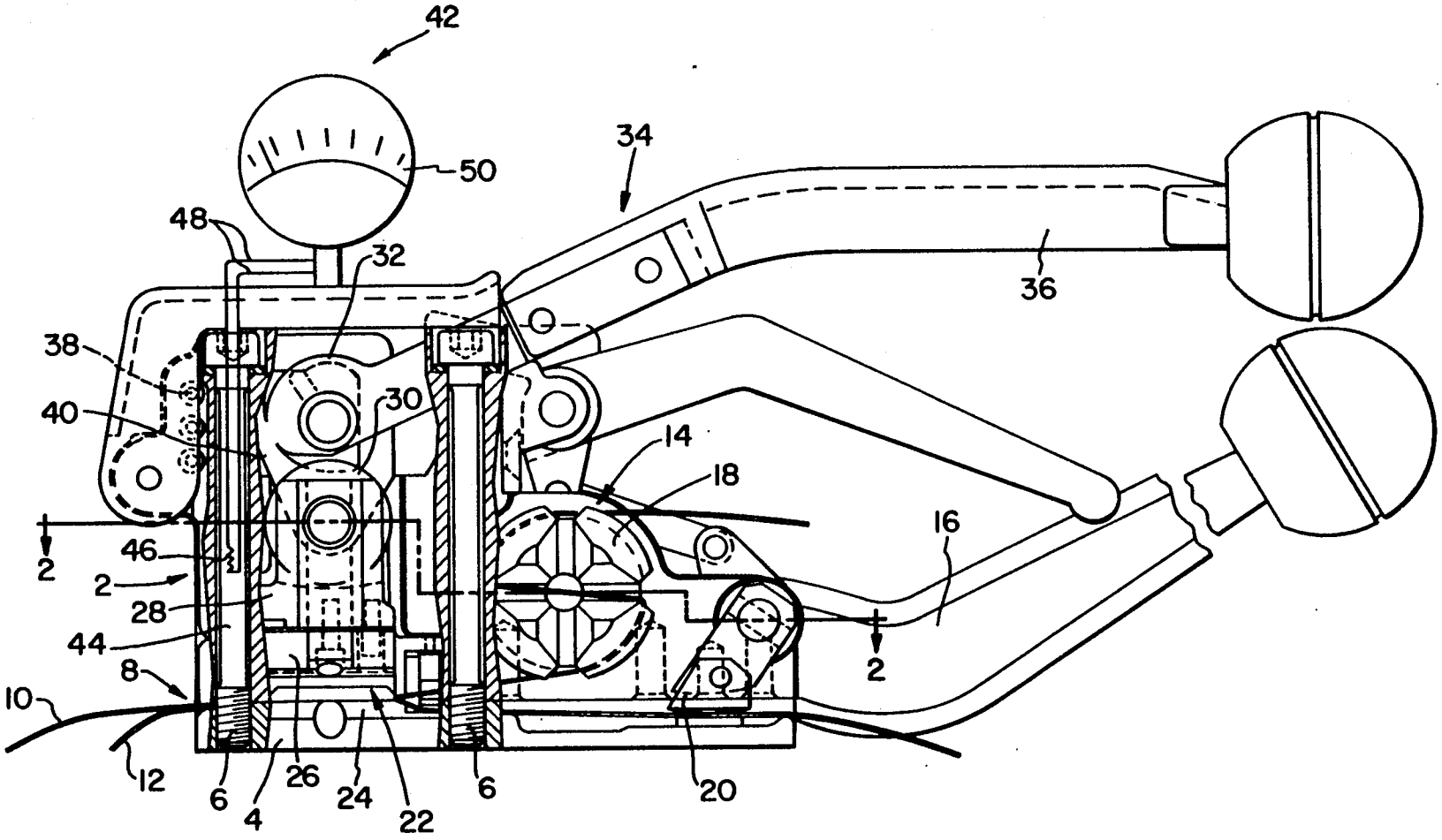
FIG. 1 shows a banding apparatus in side elevation and partly in section.
Figure 2:
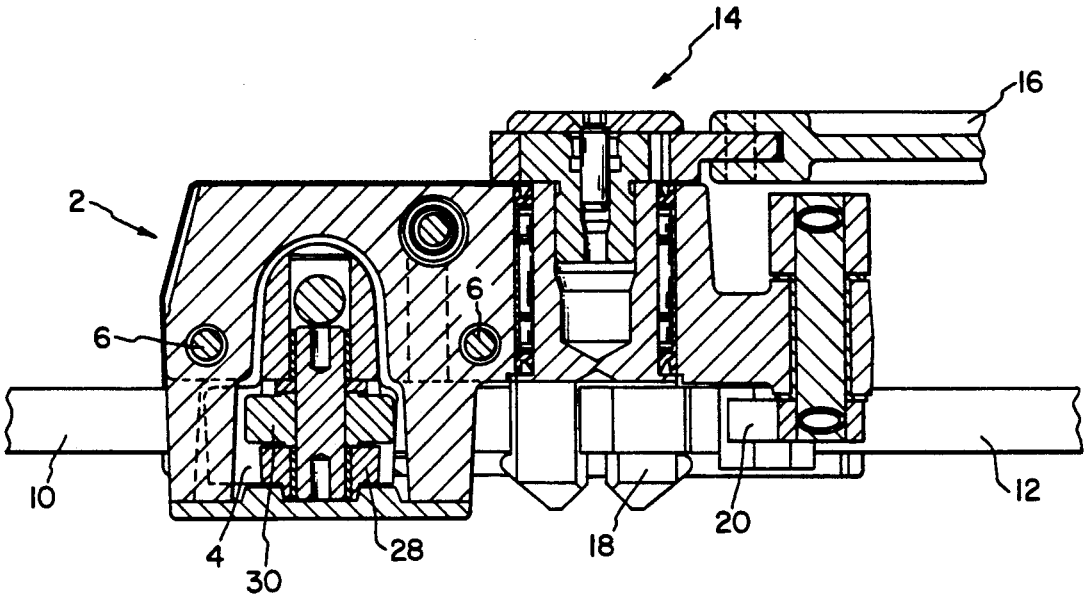
FIG. 2 shows the banding apparatus according to FIG. 1 as a section along II—II in FIG. 1; and, FIG. 3 shows the banding apparatus according to FIG. 1 as a cut-out and left-hand view.

The banding apparatus illustrated in the figures corresponds in its basic structure for instance so that of the Swiss patent document 583,089 or 646,388.

The banding apparatus illustrated in the drawings is comprised of a housing 2 bearing outwardly on a base plate 4 which is connected with the housing 2 through two expansion screws 6 arranged approximately in the center plane of the banding apparatus. Provided between the base plate 4 and the housing 2 is a receiving slot 8 in which overlapping band sections 10, 12 of a strapping band are arranged. The band sections of the strapping band, which for instance may consist of steel or plastic, are connected with one another by means of a closure seal which is not illustrated in any detail, for instance analogous to the Swiss patent document 583,089. However, it is also possible to use a steel band where the band sections are connected with each other by a punching/embossing operation, such as described in the Swiss patent document 646,383.

The banding apparatus contains in customary fashion a tightening device 14 with a tightening lever 16 that actuates a tightening drum 18 on which a band section 10 is wound in tightening. A holding jaw 20 serves to retain the other band section 12 during the tightening operation.

The tool 22 serving to connect the band sections 10, 12 contains a tool part 24 mounted on the base plate and an upper tool part 26 mounted in a punch 28. The latter is provided with a compression roll 30 which interacts with an eccentric cam 32 of a drive device 34. The latter is coupled to a press lever 36 which by pivoting to the left moves and presses the compression roll 30, and thus the upper tool part 26 against the lower tool 24. The pivoting of the press lever 36 is limited by a stop 38. A traction linkage 40 interacting with the press level serves to retract the compression roll 30 and the upper tool part 26 as the press lever 36 is pivoted back to the right-hand home position illustrated in FIG. 1. With a force of for instance 25 kN required for closure, the expansion screws 6 are prestressed with a tractive force of for instance 25 kN. If the pre-stress is exceeded in the operation of sealing the band sections 10, 12, the expansion screws will expand making the gap width of the receiving slot 8 greater. The elongation of the expansion screws 6 prevents already an over-stressing of the banding apparatus and of the seal of the strap sections 10, 12. Besides, the gap enlargement indicates to the operator of the banding apparatus any excess load, so that the sealing operation can be aborted appropriately.

FIG. 1 also shows a facultative display device 42 providing a reading as to whether the force exerted by the drive device 34 is greater than the pre-stress of the expansion screws 6, causing them to expand. For that purpose, the display device 43 comprises a strain gauge 46 which is glued on the shaft 44 of the expansion screw 6 and interacts via lines 48 with a voltmeter 50. The calibration of the display device 42 is such that the voltmeter 50 will upon change of the resistance of the strain gauge 46, due to the strength of the shaft 44, respond and thereby display the force introduced or the excessive force.

Figure 3:
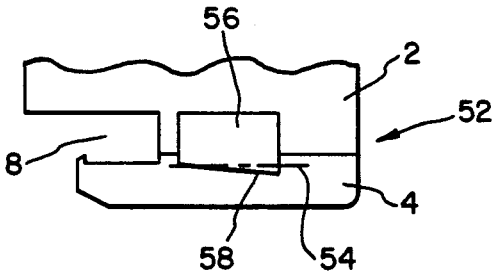

FIG. 3 shows another, very simple embodiment of a display device 52, where on the base plate 4 there is a signal strip 54 arranged that is coordinated with a cover 56 with a slanted edge 58. If the expansion screws 6 are stretched, the base plate 4 lifts off the housing 2, causing the signal strip 54 to drift downwardly out of the region of the cover 56, which becomes visible through the slanted edge 58.

What is claimed is:

1. A banding apparatus comprising: a band tightening device, tool means for connecting two overlapping band sections including an upper tool part movable by means of a drive device against a lower tool part which is arranged on a base plate, wherein between the base plate and a housing there exists a sideways open slot for receiving overlapping band sections, and wherein the base plate is connected with the housing by means of two expansion screws having an expansion shaft section.

2. The banding apparatus according to claim 1, wherein the pre-stress of the expansion screws equals at least the sealing force required in sealing the band sections.

3. The banding apparatus according to claim 2, wherein the two expansion screws are arranged at least approximately in the longitudinal center plane, parallel to the receiving slot.

4. The banding apparatus according to claim 2, wherein there is provided a display means for displaying the elongation of the expansion screws at overload.

5. The banding apparatus according to claim 1, wherein the two expansion screws are arranged at least approximately in the longitudinal center plane, parallel to the receiving slot.

6. The banding apparatus according to claim 5, wherein there is provided a display means for displaying the elongation of the expansion screws at overload.

7. The banding apparatus according to claim 1, wherein there is provided a display means for displaying the elongation of the expansion screws at overload.

8. The banding apparatus according to claim 7, wherein the display means device includes two parts that are movable relative to each other one of which forms a cover extending transverse to the direction of expansion, while the other is a signal strip extending underneath the cover, and with one of either the signal strip or an edge of the cover extending slanted relative to the horizontal.

* * * * *

UNITED STATES PATENT AND TRADEMARK OFFICE

CERTIFICATE OF CORRECTION

PATENT NO. : 5,181,546

DATED : January 26, 1993

INVENTOR(S) : Wenzel Synek

It is certified that error appears in the above-indentified patent and that said Letters Patent is hereby corrected as shown below:

Title page, item [57], Abstract, line 2, change "conected" to --connected--.
Column 1, line 53, change "in" to --on--.
Column 2, line 10, change "purposes" to --purpose--.
Column 2, line 35, change "outwardly" to --downwardly--.
Column 2, line 65, change "level" to --lever--.
Column 3, line 16, change "43" to --42--.

Signed and Sealed this

First Day of February, 1994

*Attest:*

*Attesting Officer*

BRUCE LEHMAN

*Commissioner of Patents and Trademarks*